US007055191B1

(12) United States Patent
Chen

(10) Patent No.: US 7,055,191 B1
(45) Date of Patent: Jun. 6, 2006

(54) FIXING DEVICE FOR BED CUSHION OF PLAYPEN

(76) Inventor: Owen Chen, 284, Min Chuan West Rd., Tatung, Taipei (TW)

( * ) Notice: Subject to any disclaimer, the term of this patent is extended or adjusted under 35 U.S.C. 154(b) by 0 days.

(21) Appl. No.: 11/086,695

(22) Filed: Mar. 22, 2005

(51) Int. Cl.
*A47D 7/00* (2006.01)

(52) U.S. Cl. ..... 5/93.2; 5/97; 5/98.1; 5/99.1

(58) Field of Classification Search ..... 5/93.2, 5/97, 98.1, 99.1
See application file for complete search history.

(56) References Cited

U.S. PATENT DOCUMENTS 5,349,709 A * 9/1994 Cheng ..... 5/93.1
5,578,465 A * 11/1996 Grinnell ..... 5/99.1
5,615,427 A * 4/1997 Huang ..... 5/99.1
5,991,944 A * 11/1999 Yang ..... 5/99.1
6,131,218 A * 10/2000 Wang ..... 5/93.1
6,634,038 B1 * 10/2003 Hsia ..... 5/95

* cited by examiner

*Primary Examiner*—Michael Trettel
(74) *Attorney, Agent, or Firm*—Alan D. Kamrath; Nikolai & Mersereau, P.A.

(57) ABSTRACT

A playpen includes a plurality of support bars, a bed cushion, and a fixing device to fix the bed cushion on the support bars. Thus, the snapping plate of each of the holders of the fixing device is locked on the respective positioning seat, and the sleeve of each of the holders of the fixing device is locked on the respective support bar by the locking, so that each of the holders is positioned on the respective positioning seat and the respective support bar so as to support the bed cushion rigidly and stably, thereby preventing the bed cushion from becoming loosened or detached from the playpen.

9 Claims, 6 Drawing Sheets

FIXING DEVICE FOR BED CUSHION OF PLAYPEN

BACKGROUND OF THE INVENTION

1. Field of the Invention

The present invention relates to a fixing device, and more particularly to a fixing device for a bed cushion of a playpen.

2. Description of the Related Art

A conventional playpen comprises a frame, and a bed cushion supported on the frame. However, the bed cushion is not positioned on the frame, so that the bed cushion easily becomes loosened and slips on the frame, so that a user has to make the bed cushion frequently, thereby greatly causing inconvenience to the user.

SUMMARY OF THE INVENTION

In accordance with the present invention, there is provided a playpen, comprising a plurality of support bars, a bed cushion supported on the support bars, and a fixing device mounted between the support bars and the bed cushion to fix the bed cushion on the support bars.

The primary objective of the present invention is to provide a fixing device that can position a bed cushion of a playpen efficiently to prevent the bed cushion from being detached from the playpen.

Another objective of the present invention is to provide a fixing device, wherein the snapping plate of each of the holders is locked on the respective positioning seat by the catch plate, and the sleeve is locked on the respective support bar by the locking plates, so that each of the holders is positioned on the respective positioning seat and the respective support bar so as to support the bed cushion.

A further objective of the present invention is to provide a fixing device, wherein each of the holders is locked on the respective positioning seat exactly and closely by the weight of the baby so as to support the bed cushion rigidly and stably, thereby preventing the bed cushion from becoming loosened or detached from the playpen.

Further benefits and advantages of the present invention will become apparent after a careful reading of the detailed description with appropriate reference to the accompanying drawings.

DETAILED DESCRIPTION OF THE INVENTION

Figure 1:
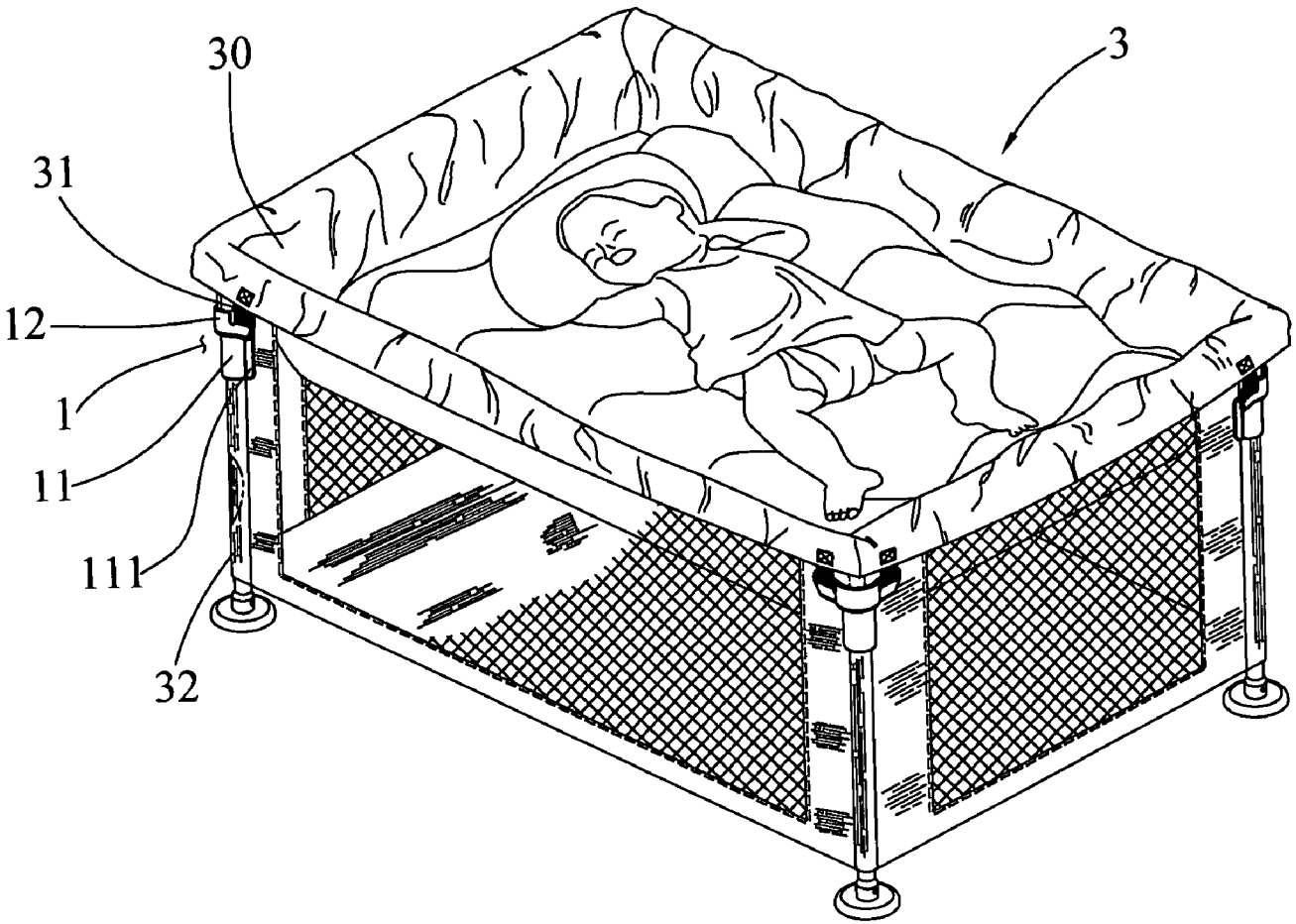
FIG. 1 is a perspective view of a playpen in accordance with the preferred embodiment of the present invention.

Referring to the drawings and initially to FIGS. 1–5, a playpen 3 in accordance with the preferred embodiment of the present invention comprises a plurality of support bars 32, a bed cushion 30 supported on the support bars 32 and provided with a plurality of fixing straps 31, and a fixing device mounted between the support bars 32 and the bed cushion 30 to fix the bed cushion 30 on the support bars 32.

The fixing device includes a plurality of positioning seats 2 each mounted on a respective one of the support bars 32, and a plurality of holders 1 each secured on a respective one of the positioning seats 2 and each connected to a respective one of the fixing straps 31 of the bed cushion 30 to fix the bed cushion 30 on the support bars 32.

Each of the positioning seats 2 has a substantially L-shaped cross-section.

Each of the holders 1 has a lower end formed with a sleeve 11 mounted on a respective one of the support bars 32 and an upper end formed with a snapping plate 12 mounted on a respective one of the positioning seats 2.

The sleeve 11 of each of the holders 1 has a substantially C-shaped cross-section to encompass a periphery of the respective support bar 32. The sleeve 11 of each of the holders 1 has two distal ends each formed with a locking plate 111 to lock the sleeve 11 on the respective support bar 32.

The snapping plate 12 of each of the holders 1 has a substantially L-shaped cross-section to encompass a periphery of the respective positioning seat 2. The snapping plate 12 of each of the holders 1 has a bottom formed with a catch plate 120 (see FIG. 4) rested on a bottom of the respective positioning seat 2 to secure the snapping plate 12 on the respective positioning seat 2. The snapping plate 12 of each of the holders 1 has two sides each formed with a fixing slot 121 for binding a respective one of the fixing straps 31 of the bed cushion 30 to fix the bed cushion 30 on the snapping plate 12 of each of the holders 1.

Figure 2:
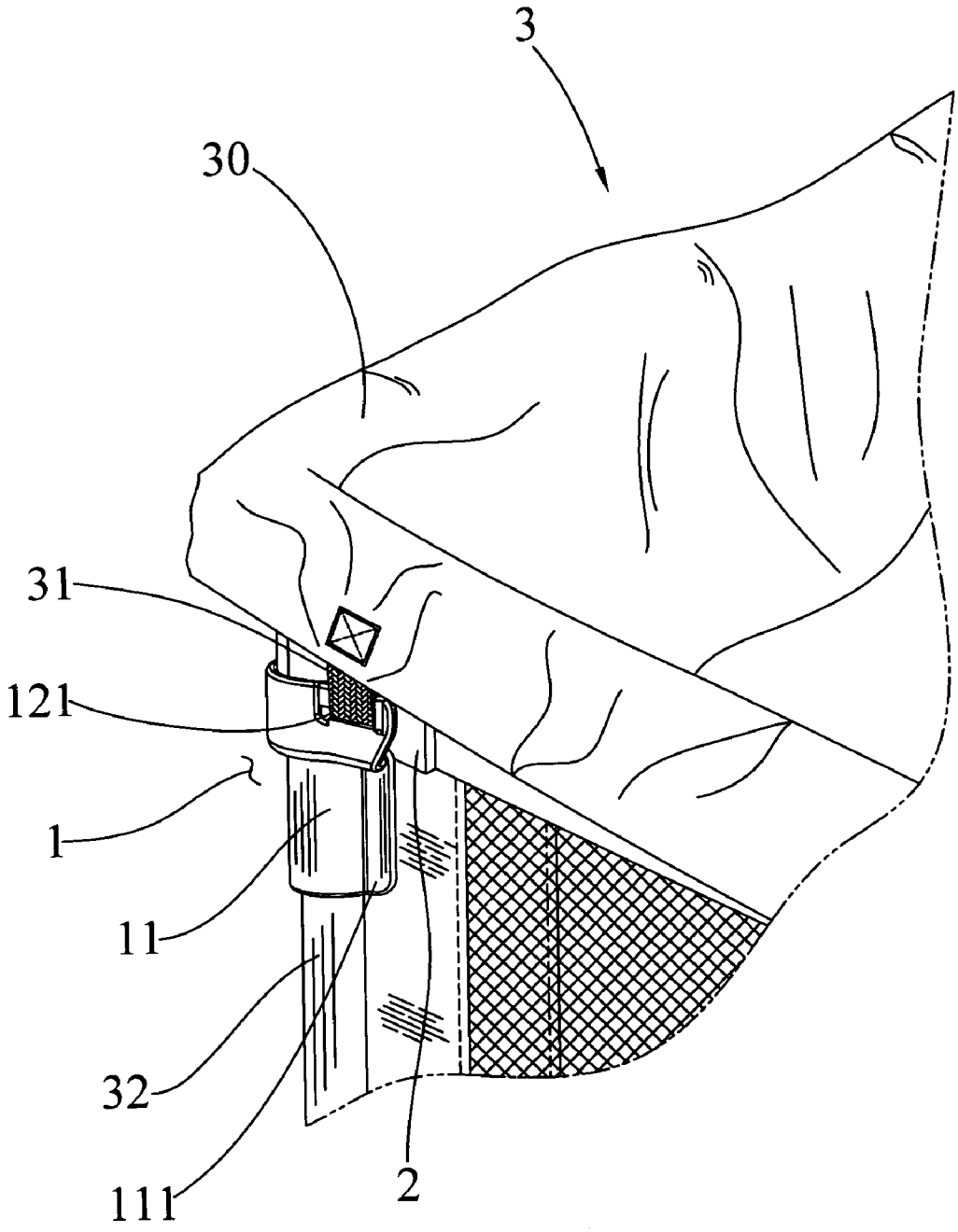
FIG. 2 is a locally enlarged view of the playpen as shown in FIG. 1.
Figure 3:
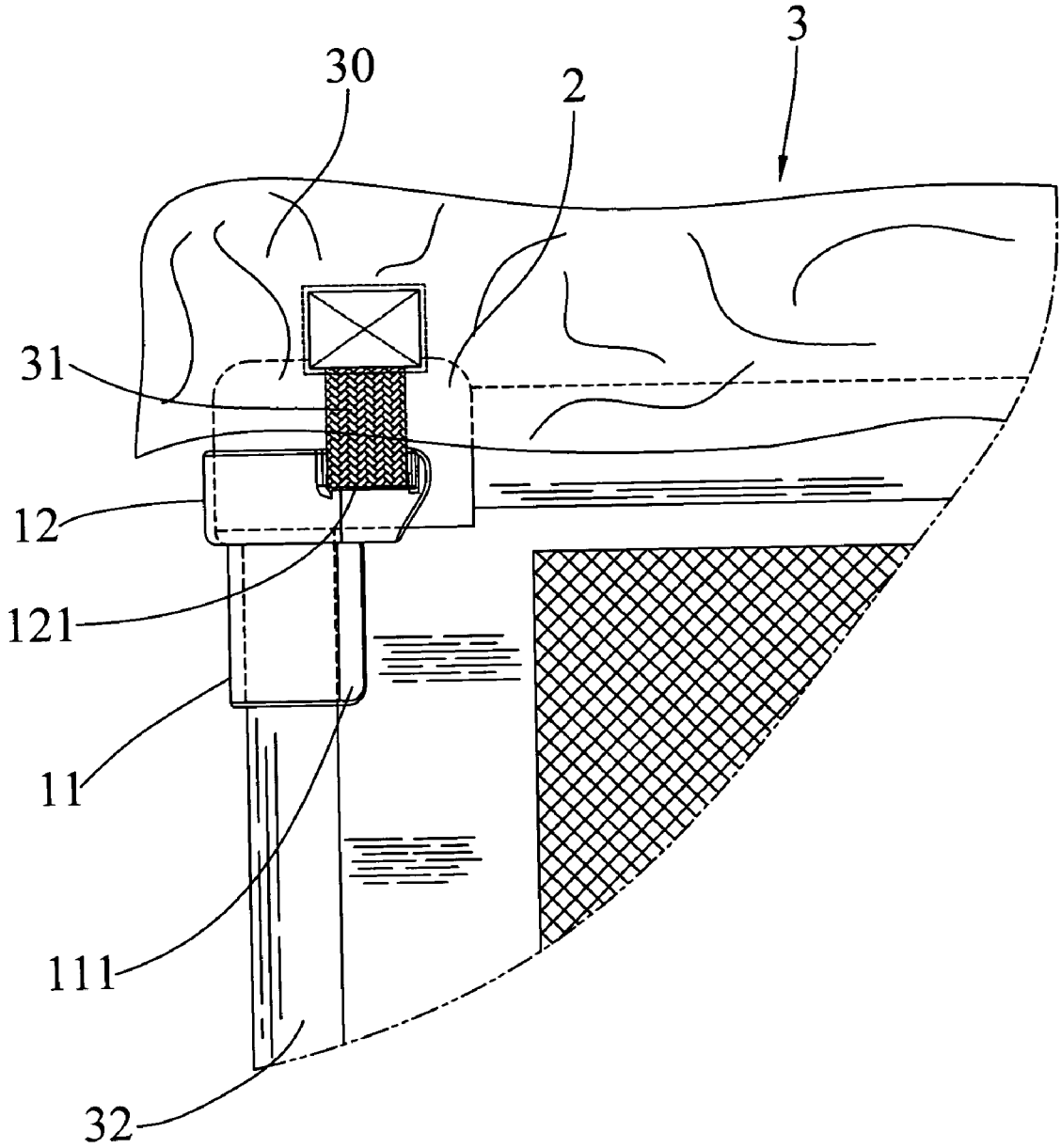
FIG. 3 is a plan view of the playpen as shown in FIG. 1.
Figure 4:
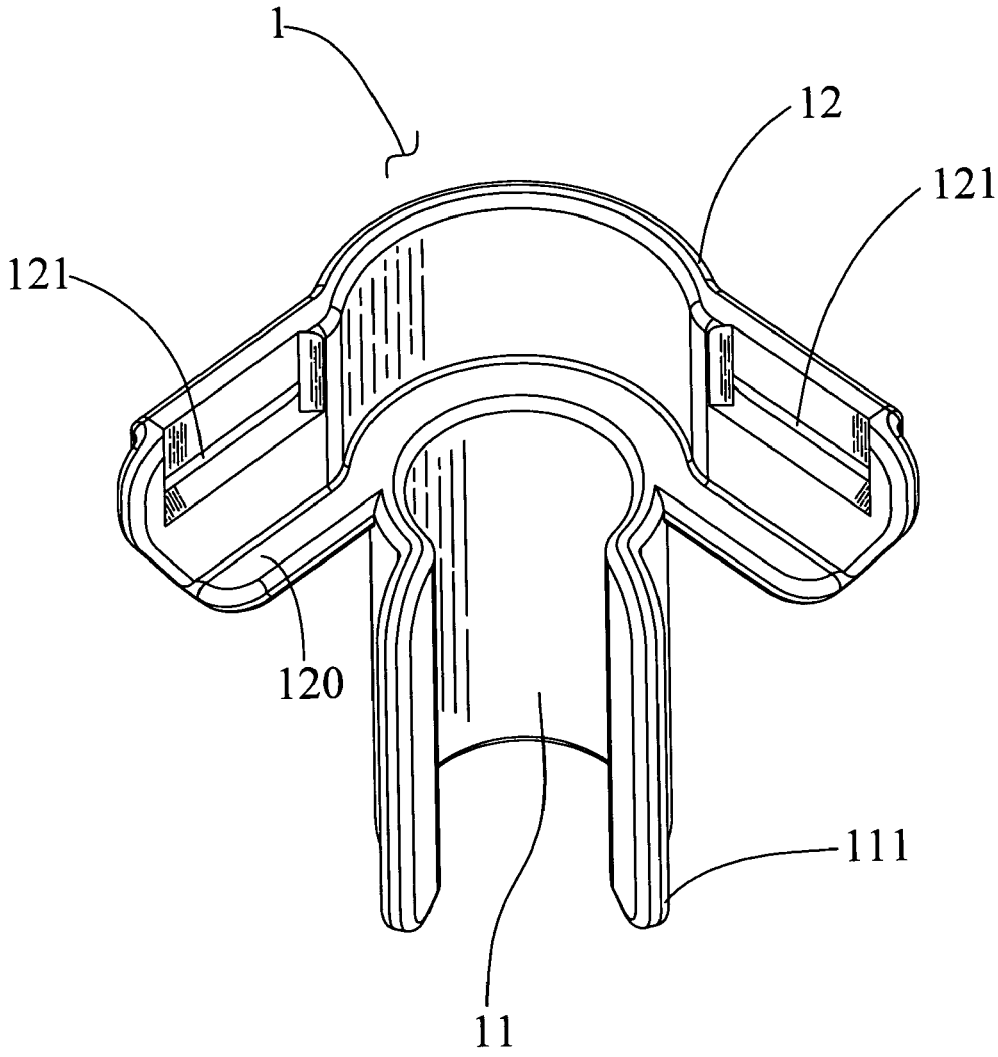
FIG. 4 is a perspective view of a fixing device for the playpen in accordance with the preferred embodiment of the present invention.
Figure 5:
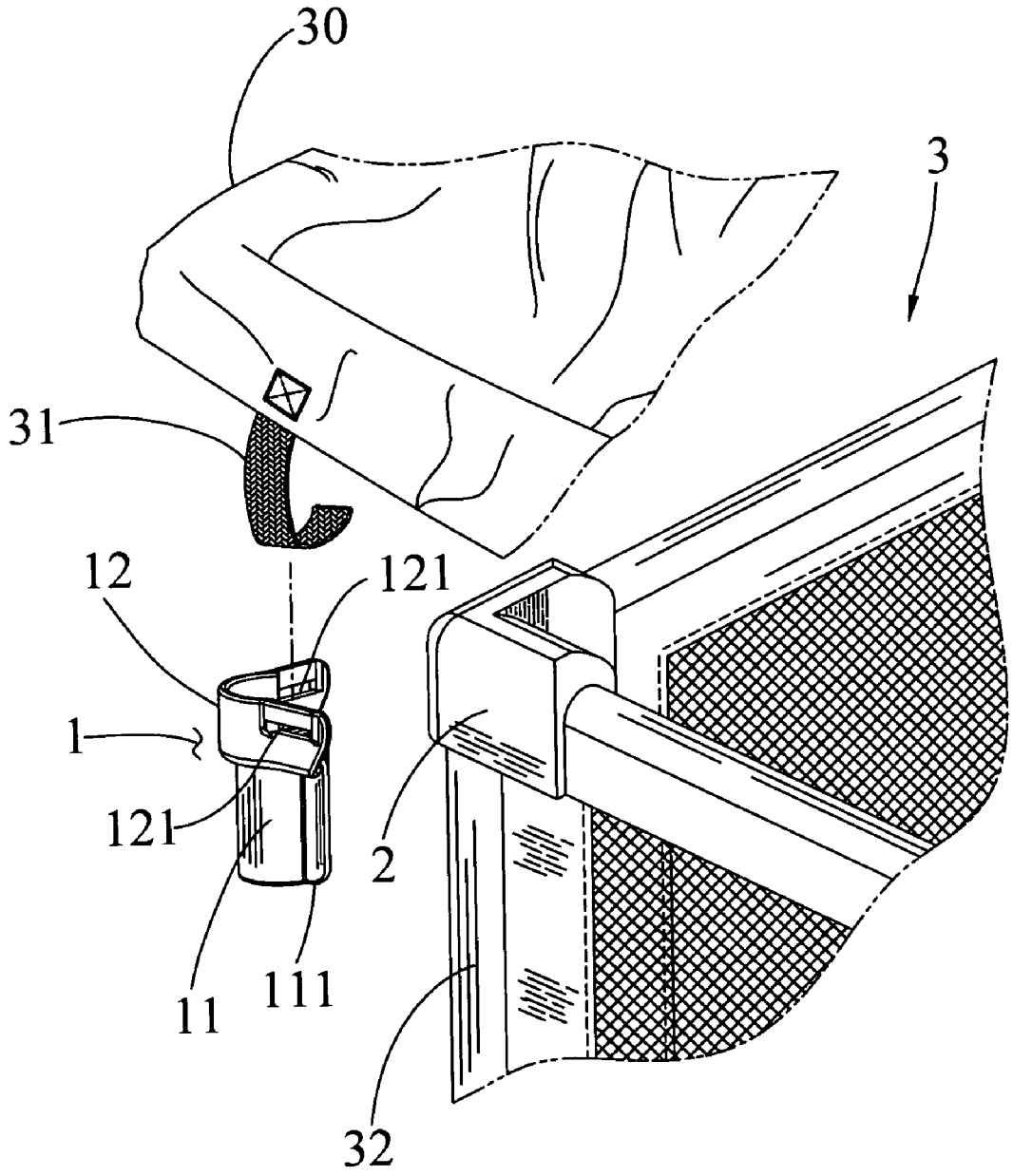
FIG. 5 is an exploded perspective view of the playpen as shown in FIG. 2.
Figure 6:
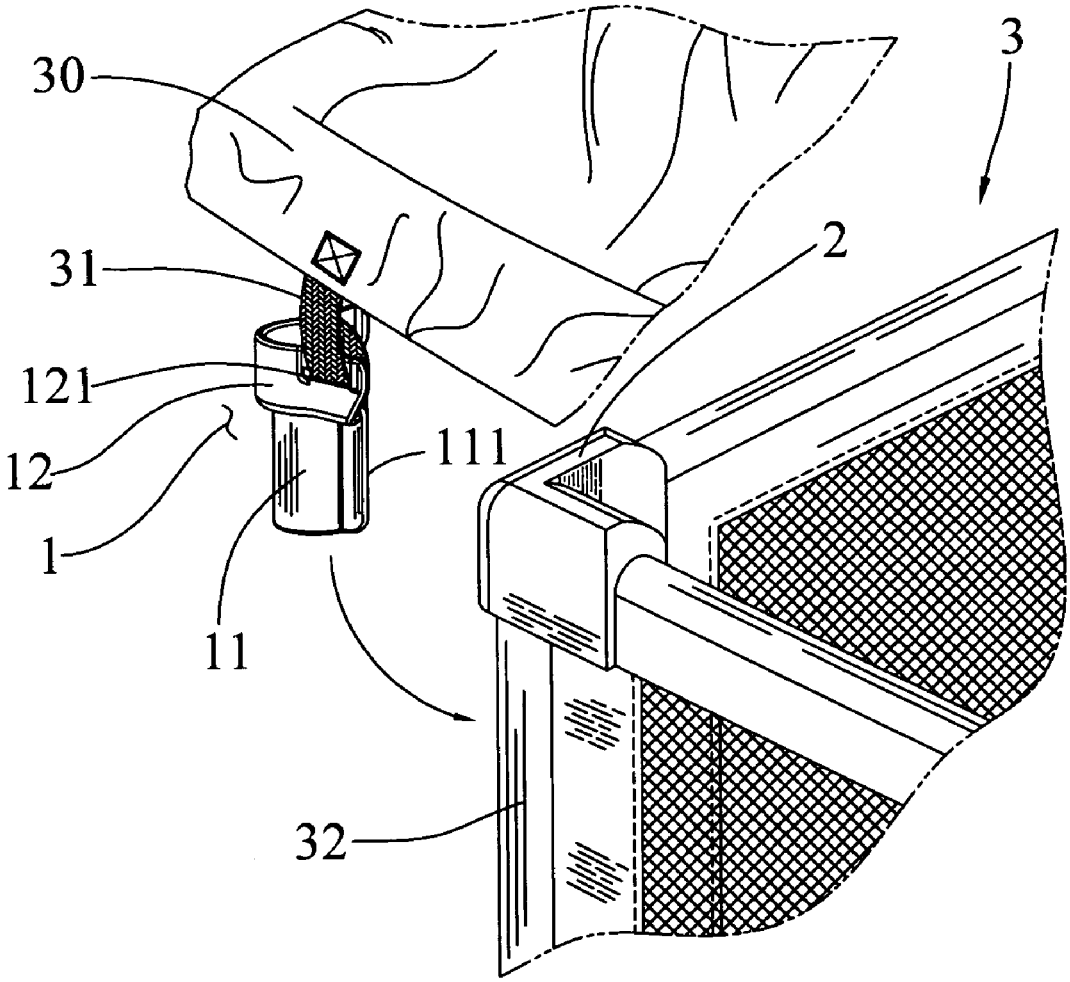
FIG. 6 is a partially exploded perspective view of the playpen as shown in FIG. 2.

In assembly, referring to FIGS. 1–6, each of the positioning seats 2 is mounted on a respective one of the support bars 32 as shown in FIG. 5. Then, each of the fixing straps 31 of the bed cushion 30 is fixed by the fixing slots 121 of the snapping plate 12 of each of the holders 1 to attach each of the holders 1 to the bed cushion 30 as shown in FIG. 6. Then, each of the holders 1 is mounted on the respective positioning seat 2 and the respective support bar 32 as shown in FIGS. 2 and 3. At this time, the snapping plate 12 of each of the holders 1 is locked on the respective positioning seat 2 by the catch plate 120, and the sleeve 11 is locked on the respective support bar 32 by the locking plates 111, so that each of the holders 1 is positioned on the respective positioning seat 2 and the respective support bar 32 to support the bed cushion 30.

When a baby is placed on the bed cushion 30, each of the fixing straps 31 of the bed cushion 30 is subjected to an upward force applied by the weight of the baby to pull each of the holders 1 upward, so that each of the holders 1 is locked on the respective positioning seat 2 exactly and closely so as to support the bed cushion 30 rigidly and stably.

Accordingly, the snapping plate 12 of each of the holders 1 is locked on the respective positioning seat 2 by the catch plate 120, and the sleeve 11 is locked on the respective support bar 32 by the locking plates 111, so that each of the holders 1 is positioned on the respective positioning seat 2 and the respective support bar 32 so as to support the bed cushion 30. In addition, each of the holders 1 is locked on the respective positioning seat 2 exactly and closely by the weight of the baby so as to support the bed cushion 30 rigidly and stably, thereby preventing the bed cushion 30 from becoming loosened or detached from the playpen 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A playpen, comprising:

a plurality of support bars;

a bed cushion supported on the support bars; and a fixing device mounted between the support bars and the bed cushion to fix the bed cushion on the support bars;

wherein the fixing device includes a plurality of positioning seats each mounted on a respective one of the support bars, and a plurality of holders each secured on a respective one of the positioning seats;

each of the holders has a lower end formed with a sleeve mounted on a respective one of the support bars;

the sleeve of each of the holders has two distal ends each formed with a locking plate to lock the sleeve on the respective support bar.

2. The playpen in accordance with claim 1, wherein the sleeve of each of the holders has a substantially C-shaped cross-section to encompass a periphery of the respective support bar.

3. The playpen in accordance with claim 1, wherein each of the holders has an upper end formed with a snapping plate mounted on a respective one of the positioning seats.

4. The playpen in accordance with claim 3, wherein the bed cushion is provided with a plurality of fixing straps, and the snapping plate of each of the holders has two sides each formed with a fixing slot for binding a respective one of the fixing straps of the bed cushion to fix the bed cushion on the snapping plate of each of the holders.

5. The playpen in accordance with claim 1, wherein the bed cushion is provided with a plurality of fixing straps, and each of the holders is connected to a respective one of the fixing straps of the bed cushion to fix the bed cushion on the support bars.

6. The playpen in accordance with claim 1, wherein each of the positioning seats has a substantially L-shaped cross-section.

7. The playpen in accordance with claim 1, wherein each of the holders is positioned on the respective positioning seat and the respective support bar to support the bed cushion.

8. A playpen, comprising:

a plurality of support bars;

a bed cushion supported on the support bars; and a fixing device mounted between the support bars and the bed cushion to fix the bed cushion on the support bars;

wherein the fixing device includes a plurality of positioning seats each mounted on a respective one of the support bars, and a plurality of holders each secured on a respective one of the positioning seats;

each of the holders has an upper end formed with a snapping plate mounted on a respective one of the positioning seats;

the snapping plate of each of the holders has a substantially L-shaped cross-section to encompass a periphery of the respective positioning seat.

9. A playpen, comprising:

a plurality of support bars;

a bed cushion supported on the support bars; and a fixing device mounted between the support bars and the bed cushion to fix the bed cushion on the support bars;

wherein the fixing device includes a plurality of positioning seats each mounted on a respective one of the support bars, and a plurality of holders each secured on a respective one of the positioning seats;

each of the holders has an upper end formed with a snapping plate mounted on a respective one of the positioning seats;

the snapping plate of each of the holders has a bottom formed with a catch plate rested on a bottom of the respective positioning seat to secure the snapping plate on the respective positioning seat.

* * * * *